US005622189A

United States Patent [19]

Dawson et al.

[11] Patent Number: 5,622,189

[45] Date of Patent: Apr. 22, 1997

[54] CIGARETTE MAKING MACHINE

[75] Inventors: John Dawson; Derek H. Dyett; Tadeusz Truszkowski, all of Bucks, England

[73] Assignee: Molins PLC, High Wycombe, England

[21] Appl. No.: 467,609

[22] Filed: Jun. 6, 1995

Related U.S. Application Data

[63] Continuation-in-part of Ser. No. 338,144, Nov. 9, 1994, Pat. No. 5,494,053.

[30] Foreign Application Priority Data

Nov. 10, 1993 [GB] United Kingdom ..... 9323145
Dec. 22, 1994 [GB] United Kingdom ..... 9425979

[51] Int. Cl.[6] ..... A24C 5/18

[52] U.S. Cl. ..... 131/84.1; 131/84.2; 131/84.3; 131/84.4

[58] Field of Search ..... 131/84.1, 84.4, 131/109.1, 109.2, 108, 280, 84.3, 84 R

[56] References Cited

U.S. PATENT DOCUMENTS 4,917,118 4/1990 Mangiavotti ..... 131/84.1
5,199,446 4/1993 Cahill et al. ..... 131/84.1
5,360,021 11/1994 Belvederi ..... 131/84.1
5,398,702 3/1995 Belvederi ..... 131/84.1
5,398,703 3/1995 Belvederi et al. ..... 131/84.1
5,494,053 2/1996 Dawson et al. ..... 131/84.1

*Primary Examiner*—Vincent Millin
*Assistant Examiner*—Charles W. Anderson
*Attorney, Agent, or Firm*—Antonelli, Terry, Stout & Kraus, LLP

[57] ABSTRACT

A twin track cigarette making machine comprises two substantially horizontal shower channels through which tobacco is arranged to be showered onto two suction bands moving in converging directions in a substantially horizontal plane and presenting substantially vertical tobacco-receiving surfaces so as to form a cigarette filler stream on each of the suction bands, and including means for enclosing each of the filler streams (possibly after trimming) in a continuous wrapper web to form two parallel cigarette rods.

20 Claims, 4 Drawing Sheets

Fig.5.
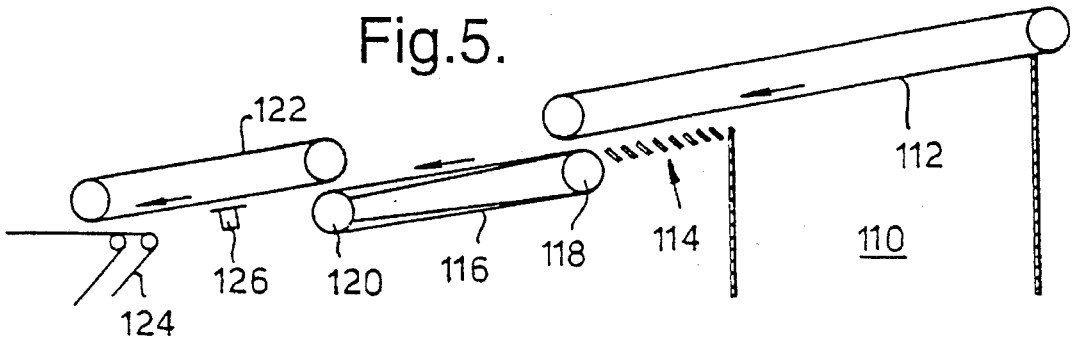
Fig.6.
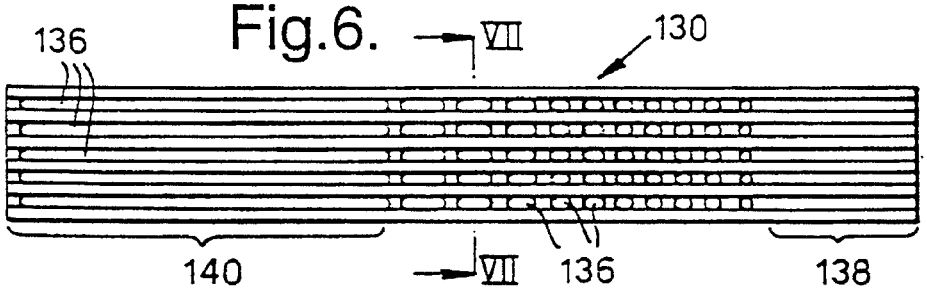
Fig.7.
Fig.8.
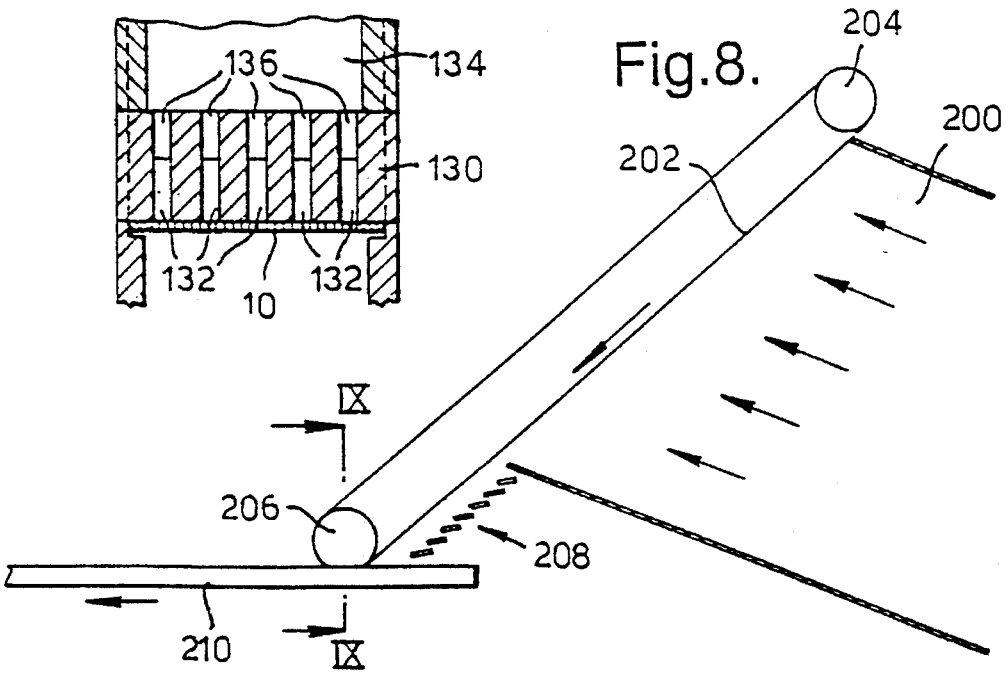
Fig.9.
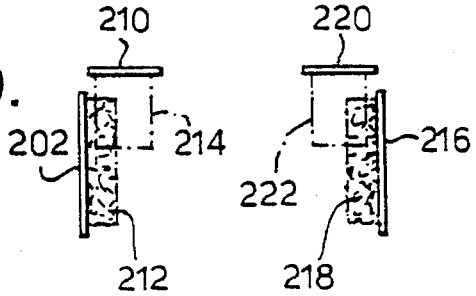

CIGARETTE MAKING MACHINE

This application is a continuation-in-part of application Ser. No. 338,144, filed 9 Nov. 1994, now U.S. Pat. No. 5,494,053, issued Feb. 27, 1996, and the subject thereof is incorporated herein by reference.

Cigarette making machines have conventionally for many years operated by forming a continuous cigarette rod comprising tobacco and/or other filler material (referred to here simply as "tobacco") enclosed in a continuous paper wrapper. This rod is then cut at regular intervals to produce separate rod lengths, comprising individual cigarette lengths or multiple cigarette lengths, which are commonly delivered by the cigarette maker to a filter attachment machine, the ultimate product therefore being a filter-tipped cigarette.

In recent years there have been proposals for increasing a cigarette maker output by dividing the tobacco output from the tobacco hopper so as to feed tobacco to two rod-forming devices arranged to form two parallel continuous rods, each of these being cut at regular intervals to produce separate rod lengths which are fed to a common filter attachment machine. A cigarette maker of this general type will be referred to as a "twin track cigarette making machine". The present invention is concerned with improvements relating to such machines.

According to one aspect of this invention, a twin track cigarette making machine comprises two substantially horizontal shower channels through which tobacco is arranged to be showered onto two suction bands moving in converging directions in a substantially horizontal plane and presenting substantially vertical tobacco-receiving surfaces so as to form a cigarette filler stream on each of the suction bands, and including means for enclosing each of the filler streams (possibly after trimming) in a continuous wrapper web to form two parallel cigarette rods.

Preferably the filler stream formed on each suction band is received by a further suction band arranged to carry the filler stream on its underneath surface and into a rod forming device (e.g., a garniture, which may be in a conventional form) by which the filler stream is enclosed in the wrapper web. Alternatively, the converging suction bands may, after the filler streams have been formed on them, pass around pulleys by which the directions of movement of the bands are made parallel, and each band may then be constrained to twist before returning around a further pulley, so that the twisting of each band results in the filler stream being carried on an underneath surface of the band whereby the filler stream can be delivered directly into the garniture by the same band.

In a preferred arrangement according to the first aspect of this invention, the two shower channels are spaced apart and at least part of a hopper by which tobacco is delivered to the shower channels extends downwards between the shower channels. The tobacco delivered through this part of the hopper is preferably metered at a level below the shower channels, and is then fed into a pair of upwardly extending shower channels communicating with the horizontal shower channels leading to the converging suction bands. Such an arrangement, especially in the preferred form described below with reference to the accompanying drawings, lends itself to convenient access by the operator to at least some parts of the machine to which access is frequently required.

The cigarette filler stream formed on each band receiving the showered tobacco is preferably substantially wider than its depth, and the machine preferably includes a tobacco redistribution feature as described below.

According to a second aspect of this invention, which may be used in combination with the first aspect of this invention, control as between the two tracks in a twin track cigarette making machine is separated whereby each track can operate independently of the other and so that, while both are operating, different control parameters can be applied to the two tracks so that, if desired, different brands of cigarettes can be made on the two tracks. For the last-mentioned purpose, the filter attachment machine is preferably also constructed on a twin-track basis, instead of the cigarette rods from the two tracks being merged, as hitherto, so as to pass through the filter attachment machine along a common track. The two filter assembly tracks may be adjacent to one another or may extend in opposite directions from the position at which the cigarette rod lengths are received by the filter attachment machine.

Examples of cigarette making machines according to this invention will now be described with reference to the accompanying drawings. In these drawings:

FIG. 5 is a diagrammatic front view of a different machine employing the tobacco redistribution feature;

FIG. 6 is an enlarged view of part of the machine shown in FIG. 1 or FIG. 5;

FIG. 7 is an enlarged cross-section on the line VII–VII in FIG. 6;

FIG. 8 is a diagrammatic plan view of part of another different machine employing the tobacco redistribution feature;

FIG. 9 is an enlarged cross-section on the line IX–IX in FIG. 8, showing the formation of a second cigarette filler stream in accordance with the invention;

Figure 1:
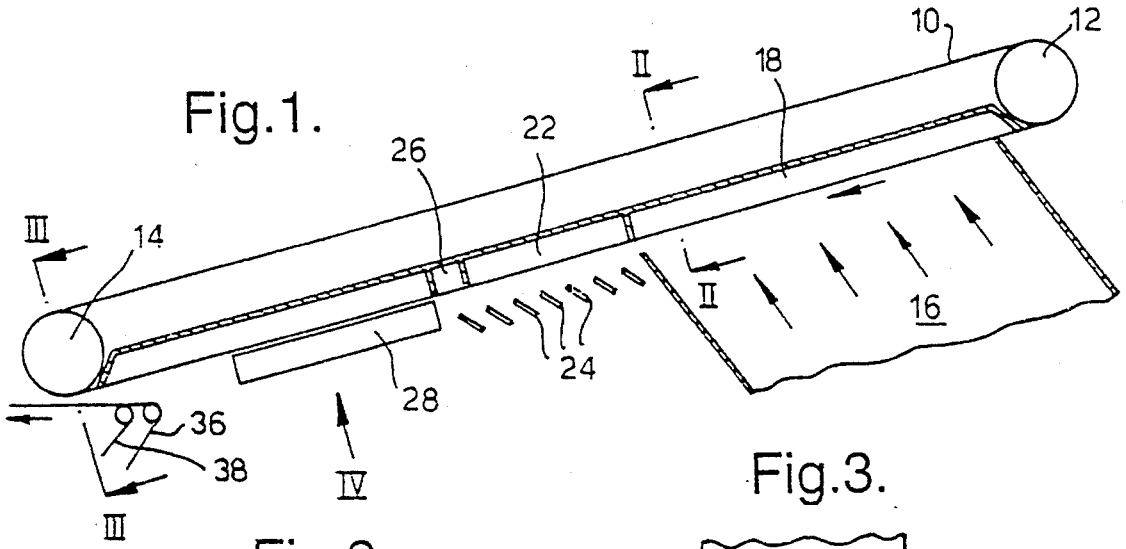
FIG. 1 shows a diagrammatic front view of a machine employing the tobacco redistribution feature which may be included in a machine according to this invention.

The machine shown in FIG. 1 comprises a conveyor in the form of a suction band 10 arranged to pass around pulleys 12 and 14, and a shower channel 16 through which tobacco is showered generally upwards to form a filler stream 20 (see FIG. 2) on the underneath surface of the band 10. It should be noted that the shower channel 16 is inclined significantly to the vertical so that tobacco arrives on the band 10 in a direction having a component in the direction of movement of the band 10; it may alternatively be vertical.

An upward air flow through the channel 16 is induced entirely by suction applied through the band from a suction chamber 18. In other words, the supercharger (a louvre below the suction band communicating with a separate suction source) commonly used in Moline machines such as the Mark 9 is omitted, though a supercharger may in fact be included if desired. The supercharger may be omitted since the relatively thin tobacco layer on the band allows sufficient air to be drawn through it.

Figure 2:
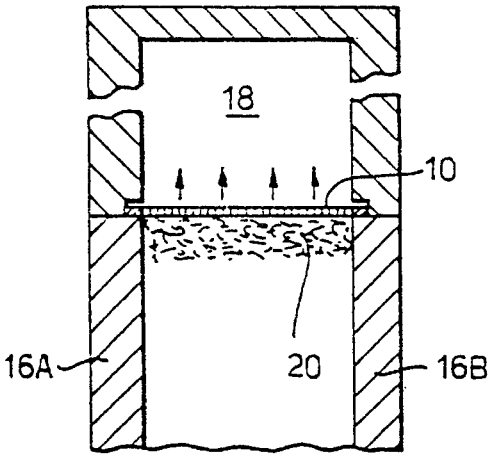
FIG. 2 is an enlarged cross-section of-part of the machine on the line II—II in FIG. 1.

The approximate cross-sectional shape of the substantially complete filler stream 20 formed on the band 10 is shown in FIG. 2. This cross-section is approximate in that the depth of the filler stream (i.e. measured normal to the band 10) varies. The average depth may be approximately 4 mm, while the width defined by side walls 16A and 16B in this example is 18 mm.

Immediately downstream of the shower channel 16, the filler stream is held lightly on the conveyor 10 by suction applied through a low-level suction chamber 22. Below the filler stream in this region there are air inlet vanes 24 which are inclined to the band 10 so as to introduce air into the space above the vanes in a direction having a component in the direction of movement of the band and filler stream. Air is induced through the vanes partly by suction in the chamber 22 but more particularly by suction applied through the band from a high-level suction chamber 26. The suction levels in the chambers 22 and 26 may, for example, be respectively approximately 4 to 6 inches (10–15 cms) and 40 inches (100 cms) water gauge.

As a result mainly of the high level of suction applied through the band by the suction chamber 26, an air flow is caused to pass along the lower surface of the filler stream in the direction of movement of the band 10 and at a higher velocity. This removes tobacco from peaks in the filler stream, and at least some of such tobacco is attracted into valleys in the filler stream represented by thinner portions of the filler stream. Consequently the filler stream, as it proceeds beyond the suction chamber 26, has a more even depth and it is believed possible to omit the usual trimming of the filler stream, though trimming may be used, if desired, for example as described below with reference to FIG. 5. This feature of the machine is herein referred to as tobacco redistribution.

Figure 4:
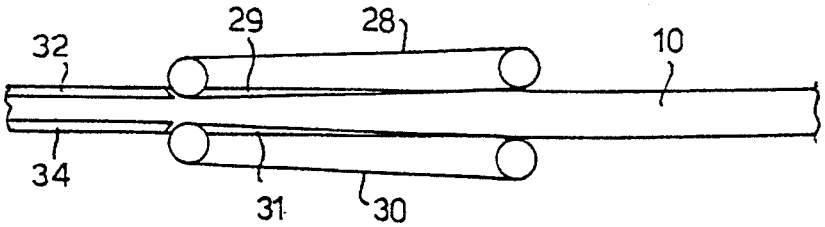
FIG. 4 is an enlarged underneath view of part of the machine in the region of the arrow IV in FIG. 1.

As shown particularly in FIG. 4, the filler stream is then reduced in width (and consequently increased in depth) by converging bands 28 and 30, after which the filler stream is confined at its sides by rails 32 and 34 substantially until the filler stream is deposited on a wrapper web 36 (FIG. 1) which is carried through the garniture of the machine (not shown) by a garniture tape 38. To aid the inward gathering of the filler stream tobacco by the converging bands 28 and 30, suction is blanked off from the band 10 in the triangular regions 29 and 31. Alternatively, instead of no suction being applied through the band 10 in those regions, air may be blown downwards through the band from appropriately formed pressure chambers above the band, while suction is applied to the band in the region between the opposed adjacent active runs of the bands 28 and 30.

Figure 3:
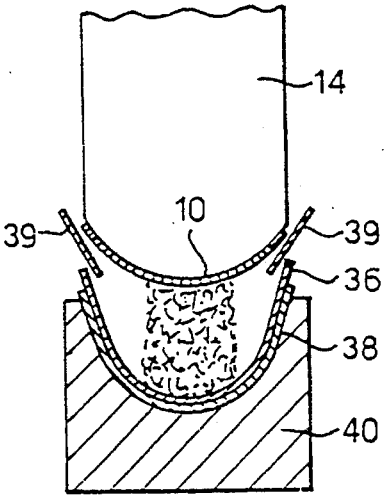
FIG. 3 is an enlarged cross-section of part of the machine on the line III—III in FIG. 1.

As shown in FIG. 3, the pulley 14 has a convex peripheral cross-section so that the edge portions of the band 10 are inclined upwards to reduce the effective width of the band 10 as it delivers the filler stream onto the wrapper web. At this stage, the garniture tape 38, and accordingly also the wrapper web 36, is concave in cross-section. Fixed guides 39 prevent contact between the edges of the band 10 and the paper 36. The garniture tape is supported by a garniture bed 40 which defines the cross-sectional shape of the tape; this shape becomes progressively more deeply concave while the filler stream, after leaving the band 10, is compressed and further shaped by the usual tongue (not shown).

Instead of the pulley 14 having a fixed-radius cross-sectional curve at its periphery, as shown in FIG. 3, its peripheral cross-section may have other shapes such as to allow the edges of the band to be deflected upwards as the band approaches the garniture. For example, a central region of the periphery of the pulley may be flat in cross-section and the outer regions may be curved or inclined upwards (as viewed in the FIG. 3 cross-section) or may be upwardly recessed.

A further possibility is that the filler stream may initially be formed on the band 10 with a narrow width and correspondingly greater depth, may be trimmed while in that form (i.e. shortly after passing the shower channel), and may then be spread sideways pneumatically to form approximately the cross-section shown in FIG. 2; for example, as described with reference to FIG. 15 to 17 of the commonly assigned U.S. Pat. No. 5,413,121 which is incorporated herein by reference. Any unevenness in the depth of the tobacco thereafter would then tend to be evened out by the action of the air flow induced by the high-level suction chamber 26 as described above.

FIG. 5 shows a different machine. In this example, tobacco is showered up a channel 110 to form a wide but shallow filler stream (as illustrated in FIG. 2) on the underneath surface of a suction band 112. A tobacco redistribution feature is applied to the filler stream in a region 114, this being possibly as described with reference to the first example or alternatively as described below with reference to FIGS. 6 and 7, and the filler stream is then transferred onto a suction band 116. This band may have a width similar to that of the band 112, and it acts to reduce the width of the filler stream effectively by folding it as the filler stream moves between pulleys 118 and 120 around which the band 116 passes. For this purpose, the pulley 120 has a concave peripheral cross-section and the band 112 is of suitably flexible material (for example, woven nylon) so that the cross-sectional shape of the band 116 becomes progressively more deeply concave as it passes between the pulleys 118 and 120, thus folding the filler stream into a narrow formation. In this form the filler stream is transferred to the underneath surface of a narrow suction band 122 which carries the filler stream onto a wrapper web 124. A trimmer 126 may be provided to trim the filler stream while it is being carried by the band 122; this trimming operation may serve mainly or partly to form the filler stream with regularly spaced dense end portions at positions corresponding to the ends of the finished cigarettes.

Instead of tobacco redistribution being achieved by means of low-level and high-level suction chambers 22 and 26 as described with reference to FIG. 1, the following alternative may be used. A single suction chamber extends along the combined length of the suction chambers 22 and 26 in FIG. 1, and suction is transmitted from this chamber through the band 10 via apertures in a band support member, which apertures are of larger cross-section towards the downstream end (or in a region corresponding to the suction chamber 26), thus allowing air to be drawn through the band at a higher rate in that region. An example of such an arrangement is illustrated in FIGS. 6 and 7.

FIG. 6 is an enlarged underneath view of part of a band support member extending effectively along the combined length of the suction chambers 22 and 26 in FIG. 1 or the region 114 in FIG. 5. This member is formed in its lower surface with a number of parallel grooves 132, as shown in FIG. 7. The lands between these grooves form support surfaces for the suction band 10. Suction is transmitted through the band 10 from a suction chamber 134 via apertures 136 opening out into each of the grooves.

In FIG. 6 the width of the band support member 130 in relation to its length is shown somewhat exaggerated for the purpose of clear illustration.

The band support member 130, along an upstream region 138, has no such apertures, while the apertures in a downstream region 140 are in the form of continuous slots so as to transmit suction with the least possible pressure drop. Between the regions 138 and 140, the apertures increase progressively in length so that the level of suction applied to the band 10 (or the air drawn through the band 10) increases progressively as the band moves from the region 138 (in which suction is temporarily not applied to the band) to the region 140, in which full suction is applied to the band.

The region 138 along which no suction is applied to the band is relatively short (for example, 25–50 mm) and we have found that cutting off suction to the band briefly is helpful in ensuring that tobacco forming peaks in the filler stream is able to separate and be accelerated faster than the band 10 by the flow of air induced by suction applied particularly through the region 140 of the band support member 130. As in FIG. 1, vanes (like vanes 24) are provided to allow air to enter the space above them with a component of motion in the direction of movement of the band, and it is this air that accelerates the tobacco which is redistributed from peaks to valleys in the filler stream.

By way of example, the region 140 of the band support member 130 may have a length of approximately 75–100 mm, and the intermediate region between the regions 138 and 140 may have a similar length as illustrated in FIG. 6.

FIG. 8 is a plan view of a different form of machine. Tobacco in this example is showered substantially horizontally through a shower channel 200 to form a wide but shallow filler stream on a suction band 202 passing around pulleys 204 and 206 which have substantially vertical axes of rotation. The filler stream formed in this way may be similar to that shown in FIG. 2, and the machine includes a redistribution area 208 which may correspond to the arrangement shown in FIG. 1 or that described with reference to FIG. 6 and 7. The filler stream is then transferred to a narrow overhead suction band 210 which carries the filler stream onto the wrapper web (not shown). While being carried by the band 210, the filler stream may be trimmed as described with reference to FIG. 5.

FIG. 9 illustrates the change of filler stream cross-section in the region of the transfer from the band 202 to the band 210. As shown in FIG. 9, the band 202 is vertically orientated in cross-section and carries a wide but shallow filler stream 212. This transforms into a narrower but deeper filler stream on the band 210 of which an approximate outline 214 is shown.

FIG. 9 also illustrates the possibility of a second wide band 216 being provided to form a filler stream 218 which is transferred to a second overhead band 220 to form a second cigarette rod parallel to the first rod. The arrangement for this purpose, in plan view, would be substantially a mirror image of that shown in FIG. 8. A machine in that form would have certain similarities with some of the machines described in commonly assigned U.S. Pat. Nos. 5,199,446, 5,141,003 and 5,413,121 which are incorporated herein by reference. The machines disclosed in those patents are concerned with using two converging suction bands to form two tobacco sub-streams which are merged to form a single cigarette filler stream. Nevertheless, reference is directed to those patents to the extent that any features disclosed in them may be applicable to the example described above with reference to FIGS. 8 and 9.

Figure 10:
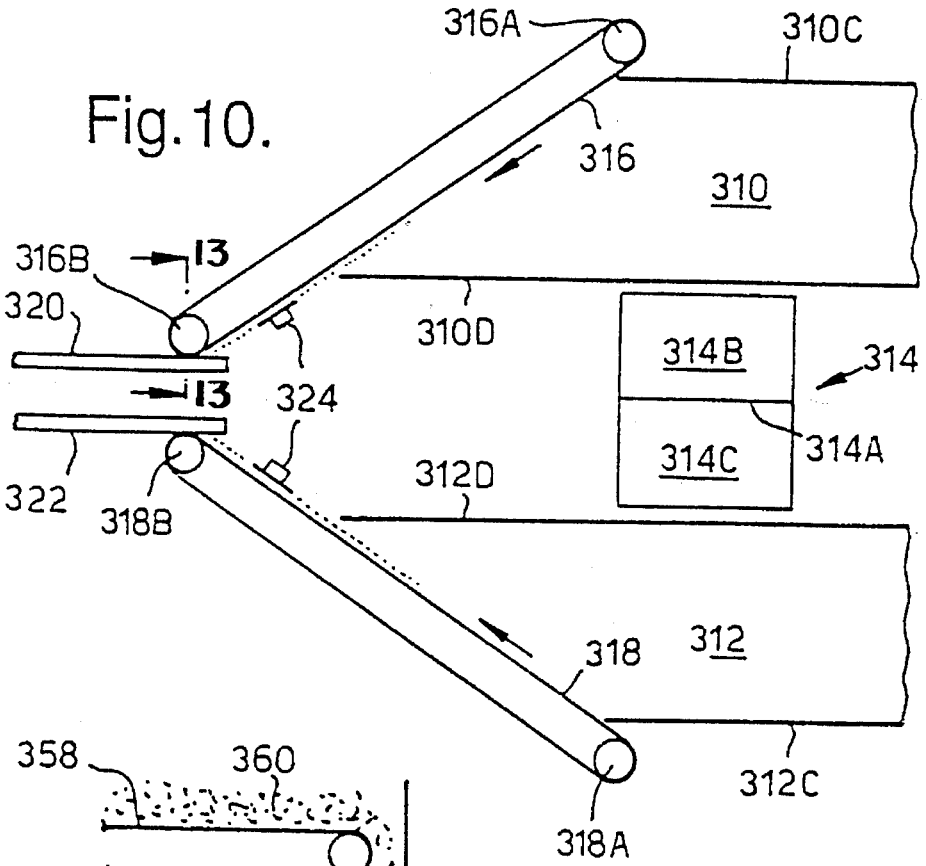
FIG. 10 is a diagrammatic plan view (partly sectioned) of part of a different machine for forming two parallel cigarette rods.

The machine shown in FIG. 10 comprises two horizontal shower channels 310 and 312 defined by upper walls 310A, 312A and lower walls 310B, 312B and by side walls 310C, 310D, 312C, 312D. The centre lines of the two channels are parallel and are spaced apart so that there is a gap between the inner side walls 310D and 312D. A part 314 of the cigarette maker hopper extends downwards between the shower channels, as shown in FIG. 10.

Tobacco showered through the shower channels 310 and 312 arrives respectively on suction bands 316 and 318 which lie in a common horizontal plane and converge towards one another at an angle such that the tobacco showered through each of the channels 310 and 312 approaches the bands 316 and 318 in a direction (or average direction) having a significant component in the direction of movement of the bands 316, 318. The bands 316, 318 pass around pulleys 316A, 316B and 318A, 318B respectively. Further suction bands 320 and 322 moving at the same speed as the bands 316, 318 and located above the bands 316, 318 (i.e, overhead) receive the filler streams from the bands 316 and 318 and carry them on their underneath surfaces into a pair of conventional garnitures (not shown) in which the filler streams are enclosed in paper wrappers.

Before being transferred to the overhead bands 320 and 322, the filler streams formed on the converging bands 316, 318 may be trimmed by trimming devices 324 as shown in FIG. 10. Alternatively, or in addition, the filler streams may be trimmed while being carried by the overhead bands 320, 322. Another possibility is that provision may be made for redistributing tobacco from generally high (thick) areas to low areas while each filler stream is being carried from the wall 310D, 312D of the corresponding shower channel to the point at which it is received by the overhead band 320, 322; such an arrangement may be as described above with reference to any one of the examples in FIGS. 1 to 9.

The hopper by which tobacco is metered and fed into the shower channels 310, 312 is essentially in two similar parts for feeding the respective shower channels. Each of these parts will be referred to as a hopper in its own right and is separately controllable. As shown in FIG. 10, the combined part 314 which passes downwards between the shower channels is divided by a wall 314A into channels 314B and 314C of equal size.

Figure 11:
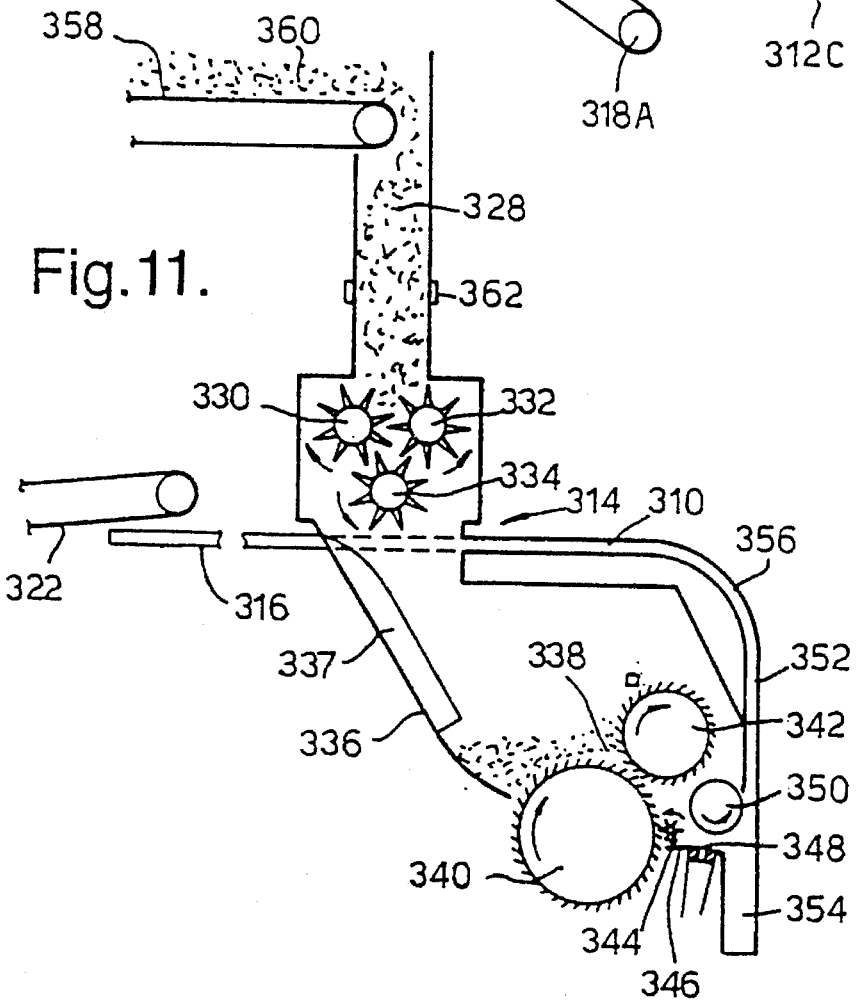
FIG. 11 is a diagrammatic elevation of part of the machine shown in FIG. 10, again partly sectioned.

Each hopper comprises a tobacco reservoir 328 (FIG. 11) from which tobacco is metered and fed downwards by means of three pin-carrying rollers 330, 332 and 334 rotating in the directions shown in FIG. 11. As a result, tobacco fed by the rollers slides down an inclined wall 336 and is then transported by a carded drum 340. A tobacco roll 338 is produced between the drum 340 and a refuser drum 342, as a result of which the drum 340 carries a metered carpet of tobacco from the roll 338 and towards a picker roller 344 which removes the tobacco from the drum 310 and projects it horizontally along a guide surface 346, past a perforated block 348 and below a perforated drum 350. Air is blown upwards through the block 348, while at the same time the interior space in the drum 350 communicates with suction so as to induce upward air currents through the tobacco. These currents deflect lighter particles of tobacco upwards into a channel 352, while heavier particles or pieces of stem continue horizontally and drop into a winnowing device 354. The arrangement in the region of the perforated block 48 and winnowing device may be similar to that used in the past in conventional Molins machines, for example as described in U.S. Pat. No. 3,092,117.

Tobacco carried up into the channel 352 continues into the channel 310 in this half of the machine, the channels 352 and 310 being joined by a curved channel portion 356.

The resulting position of the winnower 354 allows convenient access for the machine operator since it is or may be at the extreme right-hand end of the machine.

Tobacco may be delivered into the reservoir 328 in any convenient way. FIG. 11 shows, by way of example, a conveyor band 358 by which a thick carpet 360 of tobacco is fed into the reservoir 328 whenever the level of tobacco in the reservoir drops below a photocell detector 362.

It will be understood that the tobacco passing down the inclined wall 336 must also move laterally since the carded drum 340 and all subsequent components of this half of the machine are horizontally aligned with the shower channel 10. For this purpose, the wall 336 has guide vanes 337 or alternatively may be replaced by a series of separate downwardly extending ducts through which portions of the delivered tobacco can be delivered downwards and laterally.

In the event of tobacco choking one of the shower channels 310, 312 part of the lower wall 310B or 312B in the region below the rollers 330, 332, 334 may be arranged to swing downwards to drop the tobacco onto the wall 336 so as to assist in clearing the choke and to recirculate and thus not waste the tobacco.

Figure 12:
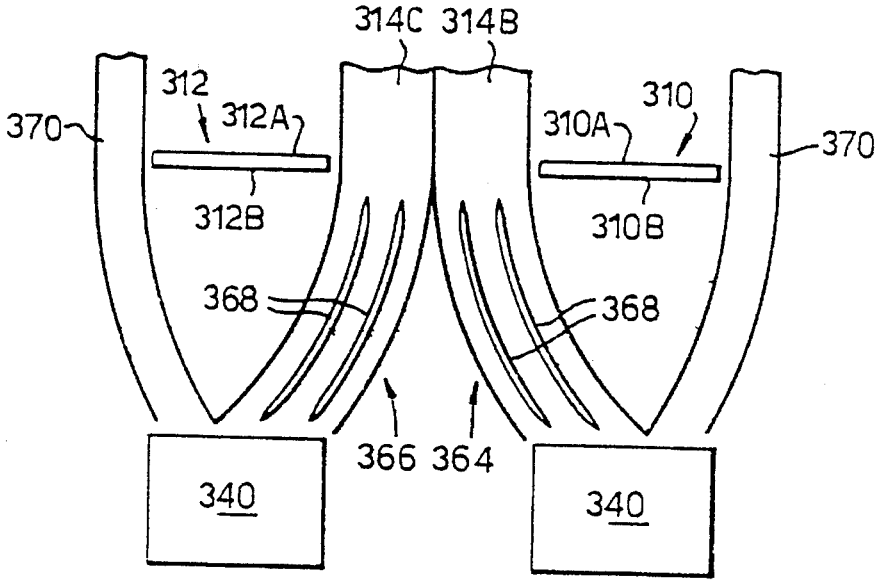
FIG. 12 is an end view of part of the same machine taken from the right of FIG. 11.

FIG. 12 illustrates a possible overall configuration of the tobacco feed towards each of the carded drums 340. In particular it shows diverging ducts 364 and 366 through which tobacco for the two carded drums 340 is fed. These ducts extend downwards from the separate channel portions 314B and 314C. Each of the ducts 364 and 366 may be subdivided into a number of thinner ducts, or may include guide vanes 368 mounted on the equivalent to the wall 336 in FIG. 11; only two guide vanes 368 are shown in each duct by way of example, but there are preferably more.

FIG. 12 illustrates an arrangement in which not all of the hopper-fed tobacco passes between the shower channels 310 and 312. By way of example, FIG. 12 illustrates an arrangement in which approximately two thirds of the tobacco is fed to each drum 340 via the duct 364 or 366. The remainder is fed via a downwardly extending duct 370 lying on the outside of the corresponding shower channel. Each of the ducts 370 may also be subdivided into a number of narrower ducts, or may have guide vanes for guiding streams of tobacco in the desired manner. In FIG. 12 the ducts 370 are shown to be narrower than the ducts 314B, 314C; they may alternatively be similar in width so that the ducts 370 feed, for example, half the total tobacco supplied by the hopper.

The tobacco (or other material) fed through the ducts 370 may be different from that fed through the ducts 364, 366. For example, the following may apply: tobacco received by the cigarette making machine is separated into two streams comprising respectively longer and shorter particles of tobacco; the longer tobacco is then fed through the ducts 364, 366, while the shorter tobacco is fed through the ducts 370 so that it will form initial layers on the bands 316, 318 and will not be removed and thus further broken by the trimming devices 324. Separation of the tobacco for this purpose may be achieved in the manner described in commonly assigned U.S. Pat. No. 5,018,538.

Figure 13:
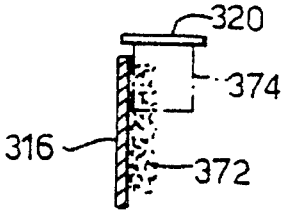
FIG. 13 is a section on the line A—A in FIG. 10.

FIG. 13 illustrates a possible cross-section on the line A—A in FIG. 10. It shows the band 316 presenting a vertical face on which tobacco showered through the duct 310 has accumulated to form a filler stream identified as 372. After the transfer to the overhead band 320, the cross-section of the filler stream 372 changes to that shown by the outline 374. Since the tobacco stream 372 formed on the band 316 is relatively thin (measured in the direction normal to the surface of the band), it is possible to cause tobacco from relatively high portions (measured horizontally) to be redistributed into areas which are relatively thin. For this purpose, as described above with reference to any of the examples shown in FIG. 1 to 9, an air stream may be induced to flow along and in the same direction as the tobacco stream 372. This redistribution arrangement may obviate the need for the trimmers 324 adjacent to the bands 316 and 318, but trimmers may alternatively be applied to the tobacco streams while they are being carried by the overhead suction bands 320 and 322.

Furthermore, in transferring from the band 316 to the band 320, and by virtue of the change of cross-section which results from the widths of the bands and the positions of side rails (not shown) confining the sides of the tobacco, the tobacco is reorientated, and this is believed to improve the filling power of the tobacco in the finished cigarettes, as described in commonly assigned U.S. Pat. No. 5,370,136 which is incorporated herein by reference.

As already mentioned, each of the hoppers supplying tobacco to form the two rods is preferably independently controlled. For that purpose, there is preferably independent control (as between the two hoppers) with respect to the initial feeds provided by the conveyors 358, with respect to each set of feed rollers 330, 332, 334, and also with respect to the speed of each carded drum 340 which determines the rate at which tobacco is metered into the corresponding shower channel. Thus each hopper operates as though it is an independent single-track machine. This enables the feed rate to be optimised in response, for example, to a signal representing the rate at which tobacco is removed by the trimmer for the corresponding track in response to the usual rod weight scanning device (commonly a neucleonic device) to produce the desired cigarette rod weight per unit length. Also, it should be appreciated that different tobacco blends can in fact be fed into the two hoppers to produce different cigarettes. Moreover, if only one track is required to be run at any given time, then that can readily be achieved.

Various of the drives in each track are preferably provided by independent electronically controlled motors.

Figure 14:
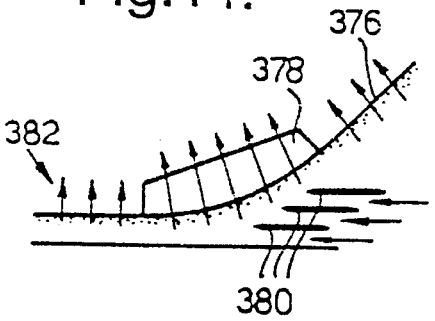
FIG. 14 shows a modification, on a larger scale, of part of the machine shown in FIG. 10.

FIG. 14 shows a possible modification whereby a band 376 (equivalent to the band 316) is guided around a relatively large-radius guide member 378 instead of the pulley 316B. A similar arrangement applies in place of the band 318. Suction applied through the member 378 (as shown by the arrows) tends to hold the cigarette filler stream on the band against centrifugal force, but allows outer tobacco particles in thicker areas of the filler stream to be carried forward, faster than the filler stream, by air admitted between parallel vanes 380. After passing around the guide member 378, the band 376 (in the region 382) moves in a direction parallel to the overhead band (not shown) and parallel to the vanes 380, before returning around a pulley (not shown). While the band is moving parallel to the top band, tobacco carried forward by the air streams admitted between the vanes tends to settle on shallower areas of the tobacco filler stream, giving the redistribution effect described above, before the entire filler stream is released by the band 376 and is then drawn upwards onto the overhead band.

The application of suction to the band 376 may be such that the tobacco when transferring to the overhead band is released progressively from the band 376, starting with tobacco closest to the overhead band.

Each overhead band may have regularly spaced regions of higher porosity so that the tobacco attracted by suction to those regions, corresponding to the end portions of the cigarettes, is at a greater density than elsewhere.

Other ways of achieving tobacco redistribution in the machine shown in FIG. 10 may be as described above with reference to FIG. 1 to 9.

Figure 15:
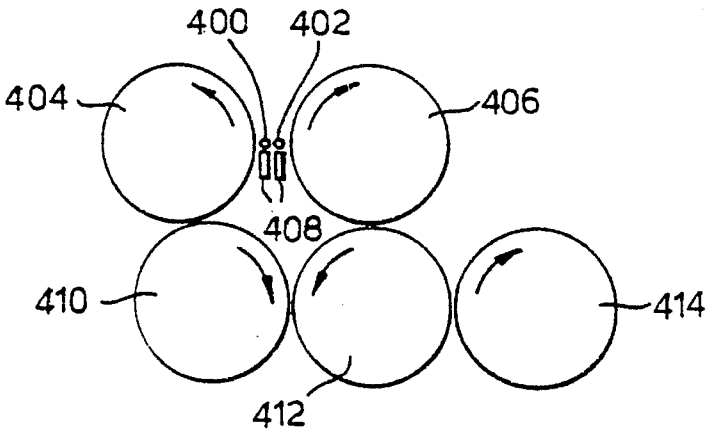
FIG. 15 is an end view of an arrangement for transferring cigarette rods from the two rod lines to a filter attachment machine.

The transfer of cigarette rod lengths (or double cigarette lengths) from each of the tracks may be achieved in the manner illustrated in FIG. 15.

Cigarette rods 400 and 402 produced by the two tracks of the machine are received respectively by fluted drums 404 and 406. Associated with each fluted drum is an accelerator cam 408 which has suction ports for accelerating each rod in turn, and at the same time deflects each rod upwards by virtue of a cam action. The fluted drums 404 and 406 rotate in opposite directions and transfer the rods to respective further fluted drums 410 and 412. The drum 410 in turn transfers the rods arriving on it to the drum 412, and the rods are then all received by a further fluted drum 414 forming part of the filter attachment machine.

This arrangement can be used for a single-track filter attachment machine or alternatively for a twin-track machine. In the first example, the flutes of the drums 404 and 410 are positioned and timed so as to deliver rods 400 into flutes between rods 402 already received on the drum 412; for this purpose the two accelerator cams 408 may be adjacent to one another. The alternative of a twin-track filter attachment machine can be satisfied by offsetting the positions of the two cams 406 in the direction of the axes of the rods 400 and 402, so that the rods are delivered to the drums 404 and 406 with their centres in different vertical but parallel planes which will form the planes of the respective separate tracks in the filter attachment machine; for this purpose it will be understood that the drum 412 (as also the drum 414) would be at least twice as long as each of the drums 404, 406 and 410, and that the drums 404 and 410 would lie with their centres in the appropriate plane offset from that of the drum 406.

We claim:

1. A twin track cigarette making machine comprising two substantially horizontal shower channels through which tobacco is arranged to be showered onto two suction bands moving in converging directions in a substantially horizontal plane and presenting substantially vertical tobacco-receiving surfaces so as to form a cigarette filler stream on each of the suction bands, and including means for enclosing each of the filler streams in a continuous wrapper web to form two parallel cigarette rods.

2. A machine according to claim 1, in which the filler stream formed on each suction band is received by a further suction band arranged to carry the filler stream on its underneath surface and into a rod forming device by which the filler stream is enclosed in the wrapper web.

3. A machine according to claim 2, in which each of the first-mentioned suction bands is arranged to form and carry a cigarette filler stream which is substantially wider than its depth, and in which each filler stream becomes deeper and less wide on transferring to the corresponding further conveyor.

4. A machine according to claim 3, including means for inducing an air flow along each filler stream while being carried by one of the first-mentioned suction bands, whereby tobacco from peaks in the filler stream tends to be carried forward and to be attracted to the suction bands by suction drawn through the band in regions of less tobacco.

5. A machine according to claim 3, in which each of the first-mentioned suction bands moves along a curved path bringing the two bands into parallel paths before the filler streams are transferred to the further suction bands.

6. A machine according to claim 5, in which the radius of each curved path and an amount of suction drawn through each band as it moves along the curved path are such that tobacco from peaks in the filler stream tends to fly off under centrifugal force, and including air flow means for carrying forward along the filler stream any such tobacco which separates from the filler stream.

7. A machine according to claim 6, in which the air flow means comprises vanes parallel to the said parallel paths of the bands.

8. A machine according to claim 4, in which the width of each filler stream on the corresponding first-mentioned suction bands is at least twice the average depth of the filler stream.

9. A machine according to claim 8, in which the width of each filler stream on the corresponding first-mentioned suction bands is at least three times the average depth of the filler stream.

10. A machine according to claim 9, in which the width of each filler stream on the corresponding first-mentioned suction bands is at least four times the average depth of the filler stream.

11. A machine according to claim 1, in which the two shower channels are spaced apart and at least part of a hopper by which tobacco is delivered to the shower channels extends downwards between the shower channels.

12. A machine according to claim 11, in which the tobacco delivered through the said part of the hopper is arranged to be metered at a level below the shower channels, and is then fed into a pair of upwardly extending shower channels communicating with the horizontal shower channels leading to the first-mentioned suction bands.

13. A machine according to claim 4, in which air forming the air flow along each filler stream is drawn through inclined vanes or other means whereby it enters a space adjacent to the filler stream with a component of motion in the direction of movement of the corresponding band.

14. A machine according to claim 4, in which the air flow is induced partly or mainly by suction applied through the band from a high-level suction chamber formed downstream of a lower-level suction chamber.

15. A machine according to claim 4, in which suction for retaining each filler stream on the band is reduced or cut off along a portion of the path of the band to enable tobacco from peaks in the filler stream to separate and be carried forward by the air flow.

16. A machine according to claim 4, including for each band a band support member formed with apertures of increasing size through which an increasing flow of air is induced through the filler stream from a suction chamber on the side of the support member remote from the band.

17. A machine according to claim 1, in which each of the suction bands, after the filler streams have been formed on them, passes around pulleys by which the directions of movement of the bands are made parallel, and each band is then constrained to twist before returning around a further pulley, so that the twisting of each band results in the filler stream being carried on an underneath surface of the band whereby the filler stream can be delivered directly into a garniture by the same band.

18. A twin track cigarette making machine having two tracks on which cigarettes are made, in which control as between the two tracks is separated whereby each track can operate independently of the other and so that, while both are operating, different control parameters can be applied to the two tracks so that, if desired, different brands of cigarettes can be made on the two tracks.

19. A process for the manufacture of cigarettes along twin tracks, comprising forming two cigarette filler streams by showering tobacco substantially horizontally onto two suction bands moving in converging directions in a substantially horizontal plane and presenting substantially vertical tobacco-receiving surfaces so as to form a cigarette filler stream on each of the suction bands.

20. A process according to claim 19, in which each filler stream formed on the said suction bands is transferred to a further suction band which carries the filler stream to a cigarette rod forming device, and in which the cross-sectional shape of each filler stream becomes narrower and deeper as a result of the transfer.

* * * * *